US005771954A

United States Patent [19]

Benner et al.

[11] Patent Number: 5,771,954

[45] Date of Patent: Jun. 30, 1998

[54] TEMPORARY OFFICE PARTITION

[75] Inventors: Douglas D. Benner, Grand Rapids; Joylene M. Battey, Kentwood; Joyce S. Bromberg, Grand Rapids; Greg D. Lamke, Hastings, all of Mich.

[73] Assignee: Steelcase Inc., Grand Rapids, Mich.

[21] Appl. No.: 660,040

[22] Filed: Jun. 7, 1996

[51] Int. Cl.[6] ..... A47G 5/00; F16M 11/00

[52] U.S. Cl. ..... 160/231.2; 52/239; 160/135; 160/351; 248/174

[58] Field of Search ..... 52/711, 239; 160/135, 160/351, 231.1, 231.2; 348/300, 688, 174, 188.8, 188.1

[56] References Cited

U.S. PATENT DOCUMENTS

| | | | |
|---|---|---|---|
| 1,429,776 | 9/1922 | Robinson | 248/300 X |
| 2,829,081 | 4/1958 | Sweem | 160/231.2 X |
| 3,213,580 | 10/1965 | Mark | 52/239 X |
| 3,382,821 | 5/1968 | Dundr | 52/239 X |
| 3,460,860 | 8/1969 | Stevens, Jr. | 52/71 X |
| 3,625,462 | 12/1971 | Jordan | 248/188.8 |
| 3,921,539 | 11/1975 | Berger | 248/188.8 X |
| 4,200,254 | 4/1980 | Nelson | 248/188.8 |
| 4,830,080 | 5/1989 | Densen | 160/351 X |
| 4,842,227 | 6/1989 | Harrington et al. | 248/300 X |
| 5,105,594 | 4/1992 | Kirchner | 52/239 |
| 5,291,708 | 3/1994 | Johnson | 52/71 X |
| 5,339,576 | 8/1994 | Fussler | 52/71 |
| 5,363,616 | 11/1994 | Hernandez | 52/71 X |
| 5,486,391 | 1/1996 | Tyner | 52/71 X |

FOREIGN PATENT DOCUMENTS

| | | | |
|---|---|---|---|
| 94604 | 6/1969 | France | 52/71 |

*Primary Examiner*—Michael Safavi
*Attorney, Agent, or Firm*—Price, Heneveld, Cooper, DeWitt & Litton

[57] ABSTRACT

A temporary office partition system is provided in which the partition is comprised of a plurality of partition panels, hinges, and bases. The panels are substantially flat, and have a bottom edge closely received in an associated partition base for support in a freestanding, substantially vertical, upright position. The base comprises at least two spaced-apart support portions disposed in a horizontally spaced relationship defining a panel receiving slot in which the panel is received. The base is supported on a floor surface in abutting fashion by laterally spaced-apart foot portions. Hinges comprising two oppositely outward facing U-shaped channels are shaped to closely receive the side edges of the panels and the U-shaped channels are interconnected by a flexible web to permit adjacent panels to be positioned in a mutually angular relationship.

15 Claims, 2 Drawing Sheets

TEMPORARY OFFICE PARTITION

CROSS-REFERENCES TO RELATED APPLICATIONS .

The present application is related to commonly assigned, co-pending U.S. Design patent application Ser. No. 29/055,583, filed , Jun. 7, 1996 entitled OFFICE PARTITION SUPPORT, now U.S. Pat. No. D 388,313, which is hereby incorporated by reference.

BACKGROUND OF THE INVENTION

The present invention relates to furnishings, and in particular to a temporary office partition.

Office partitions and office partitioning systems are generally well-known in the art, and typically comprise multiple prefabricated panels which can be juxtaposed and interconnected to form an enlarged partition to separate an open room area into two or more smaller areas, such as for office conference areas, classrooms, cafeterias, and other similar environments. Such prior art partitions are normally somewhat heavy and awkward to reconfigure so that they usually require more than one person to handle effectively, and also require tooling of some kind to interconnect adjacent panels. Still other partitioning systems are designed to be mobile in nature, wherein systems may comprise one or more features such as having multiple panels hinged in accordion-style for ease of expansion and retraction. Such mobile partition system may also have support braces to maintain the partition upright or legs on casters to easily transport the partition between a storage area and an area which is desired to be divided.

While these partitioning systems are generally effective in partitioning desired areas in a room, they tend to be either cumbersome or limited to the length and height which such systems may provide. The increased popularity of team problem solving and collaborative work styles creates the need for a partitioning system which can move and change rapidly with the ever changing requirements of team activities and work needs and which can be erected in multiple configurations and readily dismantled for storage or erection at an alternate location.

SUMMARY OF THE INVENTION

One aspect of the present invention is to provide a temporary office partition for use in open office environments and the like, comprising a substantially flat panel having a top edge, a bottom edge, and opposite side edges. The temporary office partition also includes a partition base which supports the panel in a freestanding, substantially vertical, upright position, wherein the partition base comprises at least two spaced-apart support portions disposed in a horizontally spaced relationship which defines a panel receiving slot in which the panel is closely received, and also comprising laterally spaced-apart foot portions shaped for abutting support on a floor surface to securely retain the panel in a freestanding upright position. The partition also comprises a hinge having two oppositely outward facing, U-shaped channels for closely receiving within the channel a side edge of the panel, the U-shaped channels being interconnected by a flexible web to permit like panels to be positioned in a mutually angular relationship.

Another aspect of the present invention is a temporary office partition system for use in open office environments and the like, comprising a plurality of substantially flat panels, each of the panels having a top edge, a bottom edge, and opposite side edges. A plurality of partition bases are also included in the partition system, wherein the partition bases support the panels in a freestanding, substantially vertical upright position, wherein each partition base comprises at least two spaced-apart support portions disposed in a horizontally spaced relationship defining a panel receiving slot therebetween in which the panel is closely received, and also comprising laterally spaced-apart foot portions shaped for abutting support on a floor surface to securely retain the panel in a freestanding upright position. The partition also includes a plurality of hinges, wherein each hinge comprises two oppositely outward facing U-shaped channels shaped to closely receive therein a side edge of a panel, and wherein the channels are interconnected by a flexible web to permit like panels to be positioned in a mutually angular relationship.

Yet another aspect of the present invention is a temporary office partition for use in open office environments and the like, comprising a partition base having at least two spaced-apart support portions disposed in a horizontally spaced relationship thereby defining a panel receiving slot therebetween and also comprising laterally spaced-apart foot portions shaped for abutting support on a floor surface. The office partition also includes a substantially flat panel having a top edge, opposite side edges, and a bottom edge which is removably received in the panel receiving slot in the partition base wherein the panel is supported in a freestanding, substantially vertical, upright position.

Still, another aspect of the present invention is a partition base for supporting and retaining an office partition panel in a freestanding, substantially vertical, upright position, wherein the partition base comprises at least two spaced-apart support portions disposed in a horizontally spaced relationship defining a panel receiving slot therebetween in which a partition panel may be closely received, and laterally spaced-apart foot portions shaped for abutting support on a floor surface to securely retain a partition panel in a freestanding, upright position.

The principle objects of the present invention are to provide a temporary office partition and related system which can be easily dismantled and re-erected by a single user to facilitate a wide variety of partition configurations and sizes. The office partition base is configured to be functional, yet easily movable by forming each of the spaced-apart support portions as L-shaped members positioned in a back-to-back relationship to form the panel receiving slot. Further, an aperture is formed in the vertical leg of the L-shaped member thereby defining a handle wherein the partition base can be easily transported by an individual. The partition system is highly versatile and lightweight, so that it can be easily reconfigured by the users, as well as relatively inexpensive.

These and other advantages of the invention will be further understood and appreciated by those skilled in the art by reference to the following written specification, claims and appended drawings.

DETAILED DESCRIPTION OF THE PREFERRED EMBODIMENTS

Figure 2:
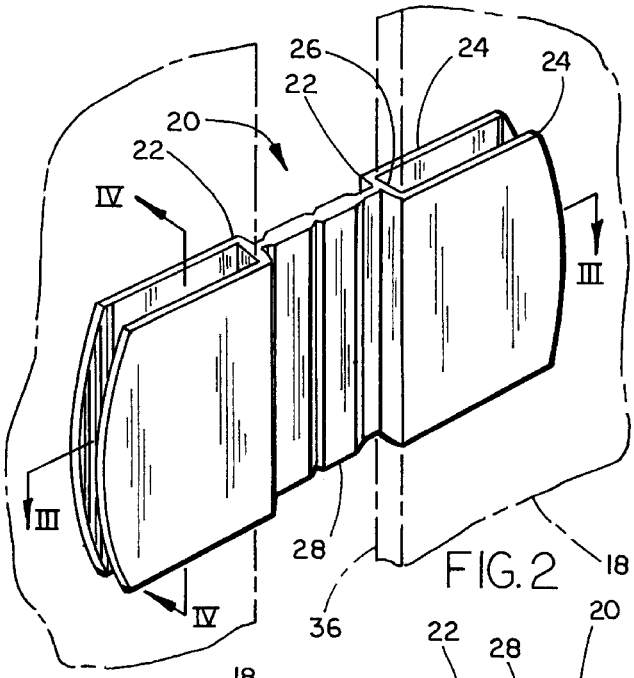
FIG. 2 is a perspective view of the hinge showing partial panel segments in phantom engaged in the hinge.
Figure 4:
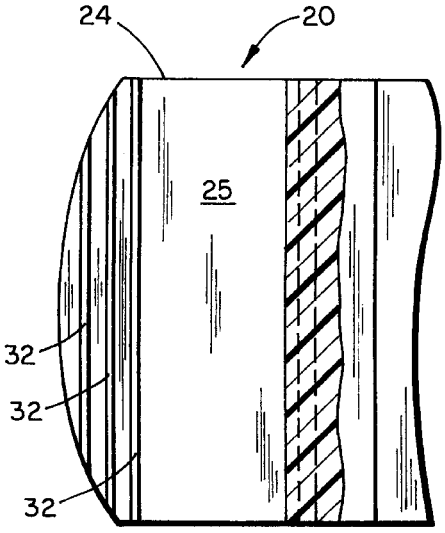
FIG. 4 is a fragmentary enlarged vertical cross-sectional view of the hinge shown in FIG. 2, taken along the line 4—4, FIG. 2.
Figure 5:
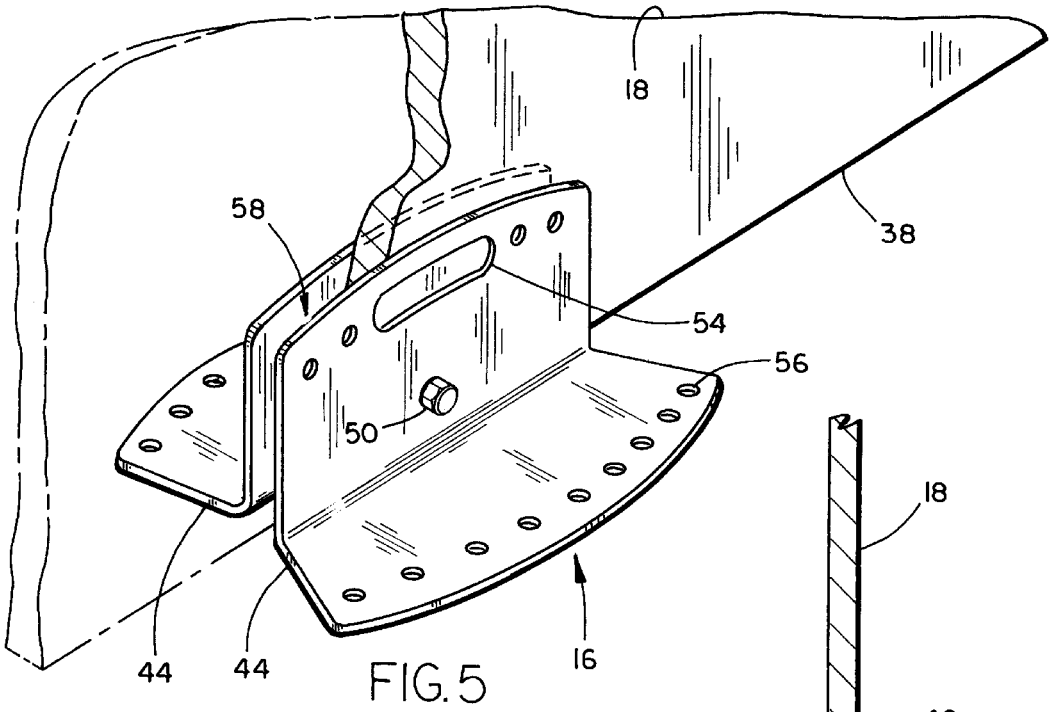
FIG. 5 is a perspective view of a partition base showing a segment of a partition panel supported by the partition base.

For purposes of description herein, the terms "upper," "lower," "left," "rear," "right," "front," "vertical," "horizontal," and derivatives thereof shall relate to the invention as oriented in FIG. 2 and FIG. 5. However, it is to be understood that the invention may assume various alternative orientations and step sequences, except wherein expressly specifies to the contrary. It is also to be understood the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
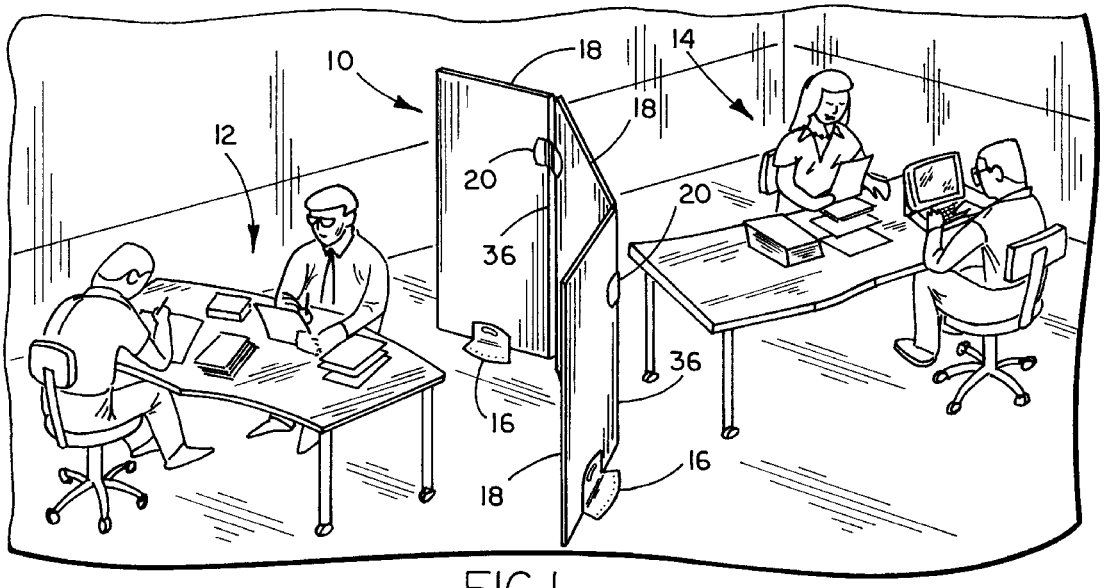
FIG. 1 is perspective view of a temporary office partition system embodying the present invention in a typical office setting.

The referenced numeral 10 (FIG. 1) generally designates a temporary office partition system embodying the present invention. In the illustrated example, temporary office partition system 10 separates office work area 12 from office work area 14 to provide multiple areas in an open office type setting wherein office personnel may work individually or in teams without disrupting other individuals or teams within the open office setting.

Temporary office partition 10 is typically comprised of a plurality of partition bases 16 which support a plurality of office panels 18 in a generally freestanding, upright position. Side edges 36 of panels 18 are generally juxtaposed in a linear fashion to form a continuous temporary partition 10. Adjacent panels 18 are typically interconnected along adjacent edges 36 by one or more hinges 20. Hinges 20 are flexible so as to permit the positioning of panels 18 in a mutually angular relationship.

The illustrated hinge 20 is generally comprised of two oppositely outward facing U-shaped channels 22 shaped to closely receive a side edge 36 of panel 18. U-shaped channel 22 is comprised of two parallel legs 24 in a spaced-apart relationship and joined at one end by base 26. The spaced-apart relationship of legs 24 is such that it substantially equals the thickness of panel 18 such that panel 18 is retained in channel 22 with a relatively snug friction fit. Retention of panel 18 in channel 22 can be aided with the addition of teeth 32 on an inner surface 25 of channel leg 24. Teeth 32 are generally oriented to face base 26 such that insertion of panel 18 into channel 22 is accomplished with less force than the force required to extract panel 18 from channel 22.

Figure 3:
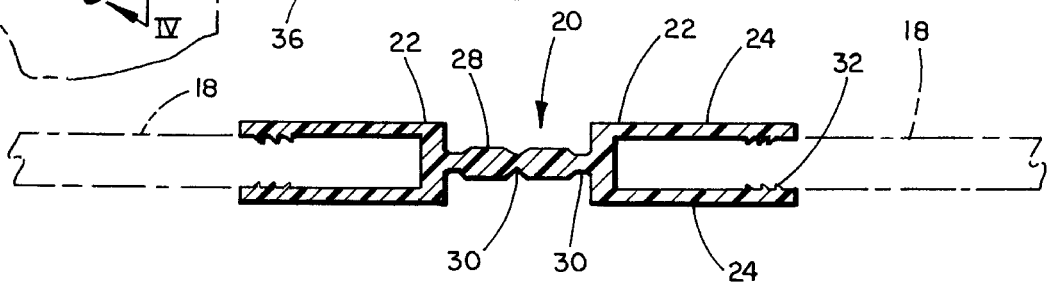
FIG. 3 is a horizontal cross-sectional view of the hinge shown in FIG. 2 taken alone the line 3—3, FIG. 2.

In the illustrated example, U-shaped channels 22 are interconnected at their respective bases 26 by web 28. Web 28 is generally formed of a flexible material to permit the flexing of channels 22 with respect to each other and thereby permitting like panels to be positioned in a mutually angular relationship when interconnected by hinges 20. Web 28 is generally formed from a flexible resinous material while channels 22 are generally formed of a rigid resinous material. As seen in FIG. 3, web 28 may also be shaped with narrow areas 30 which are thinner than the remainder of web 28 thereby concentrating the flexing of hinge 20 to narrow areas 30.

Figure 7:
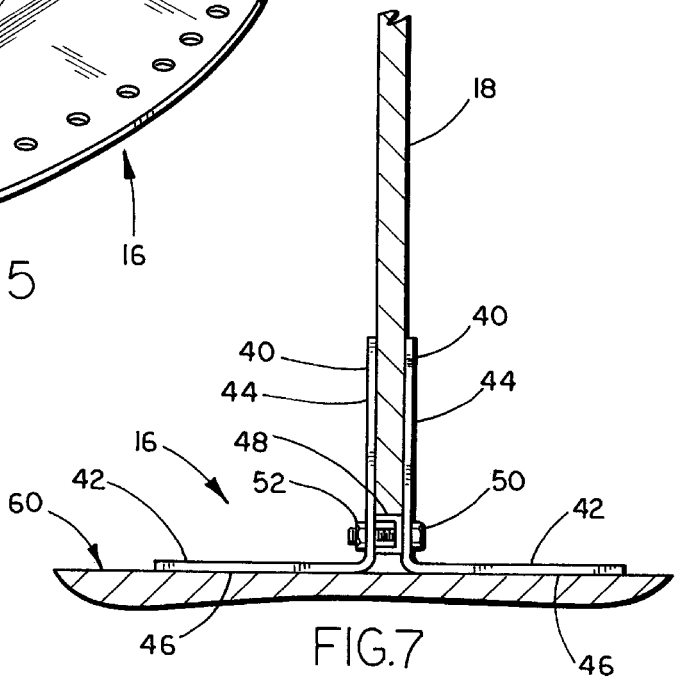
FIG. 7 is an end view of the partition base showing a segmentary partition panel supported by the partition base.
Figure 6:
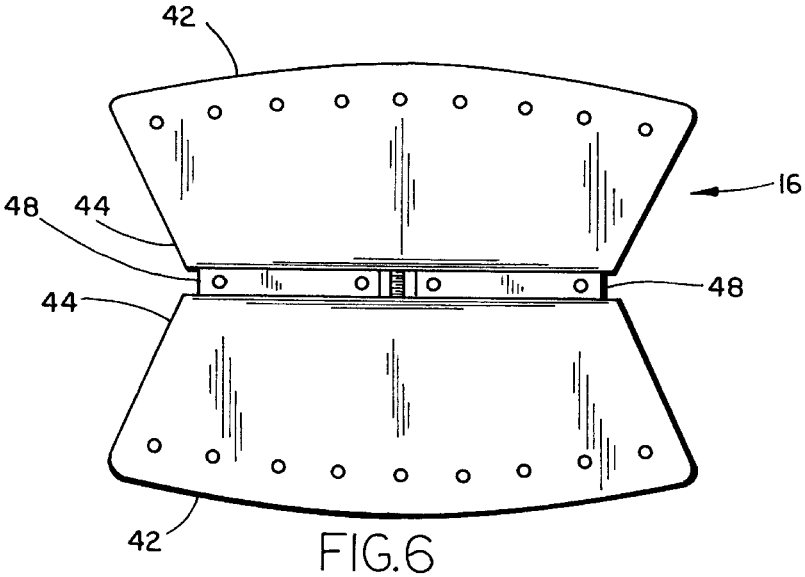
FIG. 6 is a bottom plan view of the partition base.

Turning now to FIGS. 5–7, a partition base is shown generally at 16. Base 16 is comprised of base segments 44. Base segments 44 have support portions 40 which are disposed in a horizontally spaced relationship thereby defining a panel receiving slot 58 therebetween for receiving bottom edge 38 of panel 18 in base 16. The width of panel receiving slot 58 is generally the same size as the thickness of panel 18 such that panel 18 is closely held by support portions 40 and frictionally retained therein. Base segments 44 also have a foot portion 42 which is shaped to abuttingly support base 16 and panel 18 on a floor surface 60. Base segments 44 of partition base 16 are generally formed from a material having high mass characteristics such as iron or steel to provide stability to partition system 10.

In the preferred embodiment, as shown in FIGS. 5–7, base segments 44 are formed as L-shaped members wherein support portion 40 comprises a vertical leg of the L-shaped member and foot portion 42 comprises a horizontal leg of the L-shaped member. Each base segment 44 may have an aperture in support portion 40 wherein aperture 54 defines a handle for transporting base 16 from location to location. The width of panel receiving slot 58 is defined by spacer 48 positioned between support portions 40 of base elements 44. Spacers 48 may be affixed to base elements 44 by welding or other manner, and opposite base elements 44 are retained in a mutually back-to-back spaced relationship with bolt 50 and nut 52 providing the required clamping force and wherein bolt 50 is substantially in linear alignment with spacers 48. Foot portions 42 of base elements 44 have lower surfaces 46 which are substantially coplanar for supporting partition system 10 on floor surface 60.

Base elements 44 may contain holes 56 or other such apertures or adornment for aesthetic purposes, but are not required for the functioning of base 16.

Partition panels 18 are typically of a one-piece light weight material such as foam-core board or other low-cost prefabricated material. Panels 18 can either be supplied as part of the partition system or can be provided by the user. The use of low-cost prefabricated panels which are generally commercially available allows the user to cut and shape the panels to desired sizes without incurring a significant cost or time penalty. The light weight nature of panels 18 permits the use of individual panel sizes up to four feet by eight feet or even larger while maintaining ease of assembly and disassembly.

In use, partition bases 16 are carried to the open office area which is desired to be partitioned. The bases 16 are placed on the floor in the general arrangement in which the partition 10 is desired whereupon panels 18 are inserted in panel receiving slot 58. Upon insertion of bottom edge 38 of panel 18 in base 16, support portions 40 retain panel 18 in a generally freestanding, substantially vertical, upright position. Side edges 36 of panels 18 are inserted in channels 22 of hinges 20 to interconnect adjacent panels wherein at least one hinge 20 is positioned at an upper area of adjacent edges 36, and more hinges may be utilized depending on the rigidity and height of panels 18. After assembly of bases 16, panels 18, and hinges 20, the temporary partition 10 may be positioned or repositioned as desired. When partition 10 is no longer required it can be disassembled in reverse order of its assembly for storage or movement to another location in a small period of time with minimal disruption to the work area.

An alternate configuration of partition 10 comprises one panel 18 supported by one base 16 forming individual partition elements. Such a single panel configuration may be used to separate individual workers or in areas where a small partition is desired.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A temporary office partition for use in open office environments and the like, comprising:

a substantially flat panel having a top edge, a bottom edge, and opposite side edges:

a partition base comprising horizontally elongate L-shaped members, each L-shaped member having a vertical leg and a horizontal leg, said L-shaped members oriented in an opposite horizontally spaced back-to-back relationship supporting said panel in a freestanding, substantially vertical, upright position, wherein said vertical legs of said L-shaped members of said partition base are disposed in a horizontally spaced relationship defining a panel receiving slot therebetween in which said panel is closely received, and wherein said horizontal legs of said L-shaped members define laterally spaced-apart foot portions shaped for freestanding abutting support on a floor surface to securely retain said panel in a freestanding upright position, each said foot portion of said partition base project in opposite directions from said vertical legs and at substantially right angles to said vertical legs, said foot portions having bottom surfaces which are substantially coplanar for resting on a floor surface, and a hinge comprising two oppositely outward facing, U-shaped channels shaped to closely receive therein a side edge of said panel, said channels are interconnected by a flexible web to permit like panels to be positioned in a mutually angular relationship.

2. A temporary office partition as set forth in claim 1, wherein said partition base further comprises:

a spacer disposed between said vertical legs and abutting each of said vertical legs thereby defining said horizontally spaced relationship.

3. A temporary office partition as set forth in claim 2, wherein:

said horizontally spaced relationship of said vertical legs of said partition base is substantially equal to the width of said U-shaped channel in said hinge.

4. A temporary office partition as set forth in claim 3, wherein:

said partition base further comprises a handle.

5. A temporary office partition as set forth in claim 4, wherein:

said handle is defined by an aperture in said vertical leg of said L-shaped member.

6. A temporary office partition system for use in open office environments and the like, comprising:

a plurality of substantially flat panels, each said panel having a top edge, a bottom edge, and opposite side edges;

a plurality of partition bases each said base comprising at least two horizontally elongate L-shaped members, each L-shaped member having a vertical leg and a horizontal leg, said L-shaped members oriented in an opposite horizontally spaced back-to-back relationship supporting said panels in a freestanding, substantially vertical, upright position, wherein said vertical legs of said L-shaped members of each said partition base are disposed in a horizontally spaced relationship defining a panel receiving slot therebetween in which one of said panels is closely received, and wherein said horizontal legs of said L-shaped members define laterally spaced-apart foot portions of each said partition base shaped for freestanding abutting support on a floor surface to securely retain one of said panels in a freestanding upright position, each said foot portion of each said partition base project in opposite directions from said vertical legs and at substantially right angles to said vertical legs, said foot portions having bottom surfaces which are substantially coplanar for resting on a floor surface: and a plurality of hinges, each said hinge comprising two oppositely outward facing, U-shaped channels, each said channel closely receiving therein a side edge of one of said panels, said channels interconnected b y a flexible web to permit like ones of said panels to be positioned in a mutually angular relationship.

7. A temporary office partition as set forth in claim 6, wherein said partition base further comprises:

a spacer disposed between said vertical legs and abutting each of said vertical legs thereby defining said horizontally spaced relationship.

8. A temporary office partition as set forth in claim 7, wherein:

said horizontally spaced relationship of said vertical legs of said partition base is substantially equal to the width of said U-shaped channel in said hinge.

9. A temporary office partition as set forth in claim 8, wherein:

said partition base further comprises a handle.

10. A temporary office partition as set forth in claim 9, wherein:

said handle is defined by an aperture in said vertical leg of said L-shaped member.

11. A temporary office partition for use in open office environments and the like, comprising:

a partition base comprising at least two horizontally elongate L-shaped members. each L-shaped member having a vertical leg and a horizontal leg, said L-shaped members oriented in an opposite horizontally spaced back-to-back relationship wherein said vertical legs of said L-shaped members of said partition base are disposed in a horizontally spaced relationship defining a panel receiving slot therebetween, and wherein said horizontal legs of said L-shaped members define laterally spaced-apart foot portions shaped for freestanding abutting support on a floor surface, each said foot portion of said partition base projecting in opposite directions from said vertical legs and at substantially right angles to said vertical legs. said foot portions having bottom surfaces which are substantially coplanar for resting on a floor surface ; and a substantially flat panel having a top edge, opposite side edges, and a bottom edge removably received and securely retained in said panel receiving slot in said base and supported in a freestanding, substantially vertical, upright position thereby.

12. A partition base for retaining and supporting an office partition panel in a freestanding, substantially vertical. upright position, said partition base comprising:

at least two horizontally elongate L-shaped members , each L-shaped member having a vertical leg and a horizontal leg, said L-shaped members oriented in an opposite horizontally spaced back-to-back relationship wherein said vertical legs of said L-shaped members of said partition base are disposed in a horizontally spaced relationship defining a panel receiving slot therebetween for closely receiving a partition panel. and wherein said horizontal legs of said L-shaped members define laterally spaced-apart foot portions shaped for freestanding abutting support on a floor surface, each said foot portion of said partition base projecting in opposite directions from said vertical legs and at substantially right angles to said vertical legs. said foot portions having bottom surfaces which are substantially coplanar for resting on a floor surface.

13. A partition base as set forth in claim 12, further comprising:

a spacer disposed between said vertical legs and abutting each of said vertical legs thereby defining said horizontally spaced relationship.

14. A partition base as set forth in claim 13, further comprising:

a handle.

15. A partition base as set forth in claim 14, wherein:

said handle is defined by an aperture in said vertical leg of said L-shaped member.

* * * * *

UNITED STATES PATENT AND TRADEMARK OFFICE

CERTIFICATE OF CORRECTION

PATENT NO. : 5,771,954
DATED : June 30, 1998
INVENTOR(S) : Douglas D. Benner et al.

It is certified that error appears in the above-identified patent and that said Letters Patent is hereby corrected as shown below:

Column 2, line 64;
"alone" should be --along--.

Column 3, line 16;
"specifies" should be --specified--.

Column 3, line 24;
"referenced" should be --reference--.

Column 6, claim 6, line 19;
"b y" should be --by--.

Column 6, claim 11, line 43;
"members." Should be --members,--.

Column 6, claim 11, line 55;
"legs." Should be --legs,--.

Column 6, claim 11, line 57;
"surface ;" should be --surface;--.

Column 6, claim 12, line 64;
"vertical." should be --vertical,--.

Column 6, claim 12, line 66;
"members ," should be --members,--

UNITED STATES PATENT AND TRADEMARK OFFICE

CERTIFICATE OF CORRECTION

PATENT NO. : 5,771,954
DATED : June 30, 1998
INVENTOR(S) : Douglas D. Benner et al.

It is certified that error appears in the above-identified patent and that said Letters Patent is hereby corrected as shown below:

Column 7, claim 12, line 6;
"panel." should be --panel,--.

Column 7, claim 12, line 12;
"legs." should be --legs,--.

Signed and Sealed this

Twenty-seventh Day of July, 1999

*Attest:*

Q. TODD DICKINSON

*Attesting Officer*

*Acting Commissioner of Patents and Trademarks*